US012553685B2

(12) United States Patent
Chia

(10) Patent No.: US 12,553,685 B2
(45) Date of Patent: Feb. 17, 2026

(54) HIGH PERFORMANCE LAUNCHER WITH COCKING HAMMER

(71) Applicant: EASEBON SERVICES LIMITED, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 18/876,514

(22) PCT Filed: Mar. 6, 2023

(86) PCT No.: PCT/SG2023/050132
§ 371 (c)(1),
(2) Date: Dec. 18, 2024

(87) PCT Pub. No.: WO2024/005706
PCT Pub. Date: Jan. 4, 2024

(65) Prior Publication Data

US 2025/0389513 A1 Dec. 25, 2025

Related U.S. Application Data

(60) Provisional application No. 63/367,163, filed on Jun. 28, 2022.

(51) Int. Cl.
*F41B 11/647* (2013.01)
*F41B 11/54* (2013.01)
(Continued)

(52) U.S. Cl.
CPC ..... *F41B 11/647* (2013.01); *F41B 11/54* (2013.01); *F41B 11/73* (2013.01); *F41B 11/89* (2013.01)

(58) Field of Classification Search
CPC ..... F41B 11/54; F41B 11/647; F41B 11/73; F41B 11/89
(Continued)

(56) References Cited

U.S. PATENT DOCUMENTS 4,422,433 A * 12/1983 Milliman ..... F41A 9/28 124/48
5,522,374 A * 6/1996 Clayton ..... F41B 11/646 124/66
(Continued)

FOREIGN PATENT DOCUMENTS

CN 216283011 U 4/2022
WO 2022115038 A1 6/2022

OTHER PUBLICATIONS

International Search Report issued in Application No. PCT/SG2023/050132, mailed Sep. 14, 2023.
(Continued)

*Primary Examiner* — Bret Hayes
(74) *Attorney, Agent, or Firm* — Amster, Rothstein & Ebenstein LLP

(57) ABSTRACT

A toy projectile launcher including a housing, a launch barrel, an air piston assembly, a trigger, a trigger lever having a distal end portion connected to the launch barrel, a storage cylinder rotatably mounted within the housing and comprising a plurality of projectile holders, wherein each projectile holder is configured to contain a projectile, and a spring that biases the launch barrel away from the storage cylinder. When the trigger is actuated, the trigger lever pulls the launch barrel into engagement with one of the projectile holders of the storage cylinder to form an airtight seal between a rear portion of the launch barrel and the one of the projectile holders.

22 Claims, 11 Drawing Sheets

(51) Int. Cl.
*F41B 11/73* (2013.01)
*F41B 11/89* (2013.01)

(58) Field of Classification Search
USPC ..... 124/63
See application file for complete search history.

(56) References Cited

U.S. PATENT DOCUMENTS

| | | | | |
|---|---|---|---|---|
| 9,389,042 | B1 * | 7/2016 | Clayton | F41B 11/642 |
| 2001/0027786 | A1 | 10/2001 | Kunimoto | |
| 2011/0041824 | A1 * | 2/2011 | Jablonski | F41B 11/89 124/65 |
| 2018/0149445 | A1 * | 5/2018 | Lamboy | F41B 11/54 |

OTHER PUBLICATIONS

Written Opinion issued in Application No. PCT/SG2023/050132, mailed Sep. 14, 2023.

* cited by examiner

HIGH PERFORMANCE LAUNCHER WITH COCKING HAMMER

FIELD

The present disclosure is generally related to a toy projectile launcher, such as a toy pistol, gun, and the like, for launching toy projectiles, such as foam bullets, darts, balls, and the like, with a simplified construction and improved performance.

BACKGROUND

Traditional toy projectile launchers have utilized various forms of rifles, pistols, blasters, machine guns, and the like, for launching toy projectiles, such as foam balls and darts, to name two. Such toy launchers have varied in size, power, and storage capacity. More specifically, toy launchers of foam projectiles—bullets (or "darts"), balls, and the like—have become ubiquitous. One standard for foam bullets has been marketed under the brand name Nerf® with a rubber tip and a foam body that are approximately 71.5 mm in length. There have been various types of rifles, machine guns, and the like, that have been marketed for launching such foam projectiles.

The caps of the toy darts are generally made of a material other than foam that allows the dart to be shot from the launcher at a targeted person or object and/or propelled over an appropriate distance and/or at a relatively quick speed.

Conventional dart guns have traditionally been marketed to pre-teen children for casual play. More recently, in conjunction with the advent of special event war games—such as paintball, laser tag, and the like—higher-powered launchers have been developed to target enthusiasts for such special events using foam darts.

As an example, launchers having metal barrels, instead of plastic ones, have been used for improved launching velocity. Such launchers and darts are usually dimensioned to have a very small clearance between the inner diameter of the barrel of the launcher and the outer diameter of the dart so as to provide improved launching speed and accuracy.

Further, toy launchers have been designed to resemble a pistol having a cocking hammer, reminiscent of pistols used in, for example, the "Wild West." An example of such a product is the Nerf® "HammerShot." However, these known products are focused on the 8+ category and are not very powerful, with a launching distance of about 50 feet.

With the above-mentioned metal-barreled launchers, there is a need to further improve the launching force of projectiles.

SUMMARY

To address the above, the present disclosure is generally related to an improved toy launcher for launching high performance foam darts. According to an exemplary embodiment of the present disclosure, one or more sealing mechanisms are provided to improve airtight seals from an air piston mechanism to a launch barrel of a toy projectile launcher. Advantageously, an effective and high-performance blaster may be realized that provides high velocity and accurate projectile launching.

Particularly, the present disclosure is directed to a toy launcher having a storage cylinder having projectile holders each configured to hold a projectile. In an exemplary embodiment, projectile holders are connected to one another in the form of an integral or separable belt, chain, or the like, as described in PCT Application No. PCT/SG2021/050186, the contents of which are incorporated herein by reference in their entirety. Accordingly, the present disclosure is directed to mechanisms in a launcher that take advantage of the flexible arrangement among such projectile holders to facilitate forming multiple airtight seals among components and to, thereby, form an airtight connection between a piston and a launch barrel for launching a projectile held in one of the holders. Additionally, the present disclosure is directed to a simplified construction for an improved integrated launcher with a hammer mechanism that is configured to be pressed by a user to place the launcher into a cocked configuration.

A toy projectile launcher according to an exemplary embodiment of the present invention comprises: a housing; an air piston assembly, the air piston assembly including an air piston barrel, a plunger element, and a compression spring; a launch barrel; a trigger comprising a trigger lever having a distal end portion connected to the launch barrel; a storage cylinder rotatably mounted within the housing and comprising a plurality of projectile holders, wherein each projectile holder is configured to contain a projectile; and a spring that biases the launch barrel away from the storage cylinder, wherein, when the trigger is actuated, the trigger lever pulls the launch barrel into engagement with one of the projectile holders of the storage cylinder to form an airtight seal between a rear portion of the launch barrel and the one of the projectile holders.

In an exemplary embodiment, wherein the air piston barrel comprises an outlet port.

In an exemplary embodiment, the plunger element further comprises: an outer wall comprising a first extension and a second extension; and a plunger rod that is surrounded by the compressions spring, the compression spring being at least partially housed within the outer wall.

In an exemplary embodiment, the toy projectile launcher further comprises: a cocking hammer comprising: a hammer arm having a first distal end portion pivotally attached to the air piston barrel; and a first lever arm having a proximal end portion pivotally attached to the hammer arm and a distal end portion in contact with the first extension of the outer wall of the plunger element; a trigger arm that is pivotally attached to the housing and that comprises a protrusion having a sloping front wall and a back wall; a second lever arm pivotally linked with a second distal end portion of the hammer arm and configured for engagement with the storage cylinder to cause rotation of the storage cylinder; wherein, when the cocking hammer is moved from an upper position to a lower position: the first lever arm pivots relative to the hammer arm and, due to the contact of the first lever arm with the first extension of the outer wall of the plunger element, pushes the plunger element into a cocked configuration in which the compression spring of the plunger element is compressed; the second extension of the outer wall of the plunger element slides over the sloping front wall of the protrusion of the trigger arm and into engagement with the back wall of the protrusion of the plunger element so that the plunger element is held in the cocked configuration; and the hammer arm pivots downwards so that the second lever engages with the storage cylinder and causes the storage cylinder to rotate to place a projectile within one of the projectile holders in line with the outlet port of the air piston barrel and the launch barrel.

In an exemplary embodiment, the toy projectile launcher further comprises a spring that biases the cocking hammer into the upper position so that, when the cocking hammer is released, the cocking hammer returns to the upper position while the plunger element remains in the cocked configuration.

In an exemplary embodiment, upon further actuation of the trigger, the trigger contacts the trigger arm to pivot the trigger arm out of engagement with the plunger element so that the compression spring is free to push the plunger element into the air piston barrel, thereby launching a projectile from the storage cylinder and out of the launch barrel.

In an exemplary embodiment, the toy projectile launcher further comprises a handle.

In an exemplary embodiment, the air piston assembly is at least partially disposed in the handle.

In an exemplary embodiment, the toy projectile launcher further comprises a resilient collar disposed adjacent to the outlet port so as to form an airtight seal at a rear portion of the one of the projectile holders.

In an exemplary embodiment, upon release of the trigger, the spring pulls the launch barrel away from the storage cylinder.

A toy projectile launcher according to an exemplary embodiment of the present invention comprises: a housing; an air piston assembly, the air piston assembly including an air piston barrel, a plunger element, and a compression spring; a launch barrel; a trigger comprising a trigger extension member; a storage cylinder rotatably mounted within the housing and comprising a plurality of projectile holders, wherein each projectile holder is configured to contain a projectile; a spring that biases the storage cylinder away from the launch barrel; and a push lever rotatably mounted in the housing, wherein, when the trigger is actuated, the trigger extension member engages with the push lever to rotate the push lever into engagement with the storage cylinder so that one of the projectile holders is pushed into engagement with a rear portion of the launch barrel to form an airtight seal between a rear portion of the launch barrel and the one of the projectile holders.

In an exemplary embodiment, the air piston barrel comprises an outlet port.

In an exemplary embodiment, the plunger element comprises: an outer wall comprising a first extension and a second extension; and a plunger rod that is surrounded by the compressions spring, the compression spring being at least partially housed within the outer wall.

In an exemplary embodiment, the toy projectile launcher further comprises: a cocking hammer comprising: a hammer arm having a first distal end portion pivotally attached to the air piston barrel; and a first lever arm having a proximal end portion pivotally attached to the hammer arm and a distal end portion in contact with the first extension of the outer wall of the plunger element; a trigger arm that is pivotally attached to the housing and that comprises a protrusion having a sloping front wall and a back wall; a second lever arm pivotally linked with a second distal end portion of the hammer arm and configured for engagement with the storage cylinder to cause rotation of the storage cylinder; wherein, when the cocking hammer is moved from an upper position to a lower position: the first lever arm pivots relative to the hammer arm and, due to the contact of the first lever arm with the first extension of the outer wall of the plunger element, pushes the plunger element into a cocked configuration in which the compression spring of the plunger element is compressed; the second extension of the outer wall of the plunger element slides over the sloping front wall of the protrusion of the trigger arm and into engagement with the back wall of the protrusion of the plunger element so that the plunger element is held in the cocked configuration; and the hammer arm pivots downwards so that the second lever engages with the storage cylinder and causes the storage cylinder to rotate to place a projectile within one of the projectile holders in line with the outlet port of the air piston barrel and the launch barrel.

In an exemplary embodiment, the toy projectile launcher further comprises a spring that biases the cocking hammer into the upper position so that, when the cocking hammer is released, the cocking hammer returns to the upper position while the plunger element remains in the cocked configuration.

In an exemplary embodiment, upon further actuation of the trigger, the trigger contacts the trigger arm to pivot the trigger arm out of engagement with the plunger element so that the compression spring is free to push the plunger element into the air piston barrel, thereby launching a projectile from the storage cylinder and out of the launch barrel.

In an exemplary embodiment, the toy projectile launcher further comprises a handle.

In an exemplary embodiment, the air piston assembly is at least partially disposed in the handle.

In an exemplary embodiment, the toy projectile launcher further comprises a resilient collar disposed adjacent to the outlet port so as to form an airtight seal at a rear portion of the one of the projectile holders.

In an exemplary embodiment, upon release of the trigger, the spring pushes the storage cylinder away from the launch barrel.

In an exemplary embodiment, the projectiles are foam darts.

BRIEF DESCRIPTION OF THE DRAWINGS

Exemplary embodiments of the present disclosure will be described with references to the accompanying figures, wherein.

DETAILED DESCRIPTION

The present disclosure is generally related to an improved toy launcher with an assembly for sealing a launch barrel to thereby improve the air pressure launch force. To achieve this objective, according to an exemplary embodiment, a toy launcher incorporates internal sealing assemblies for improving airway seals between an air piston assembly and a launch barrel.

Figure 1:
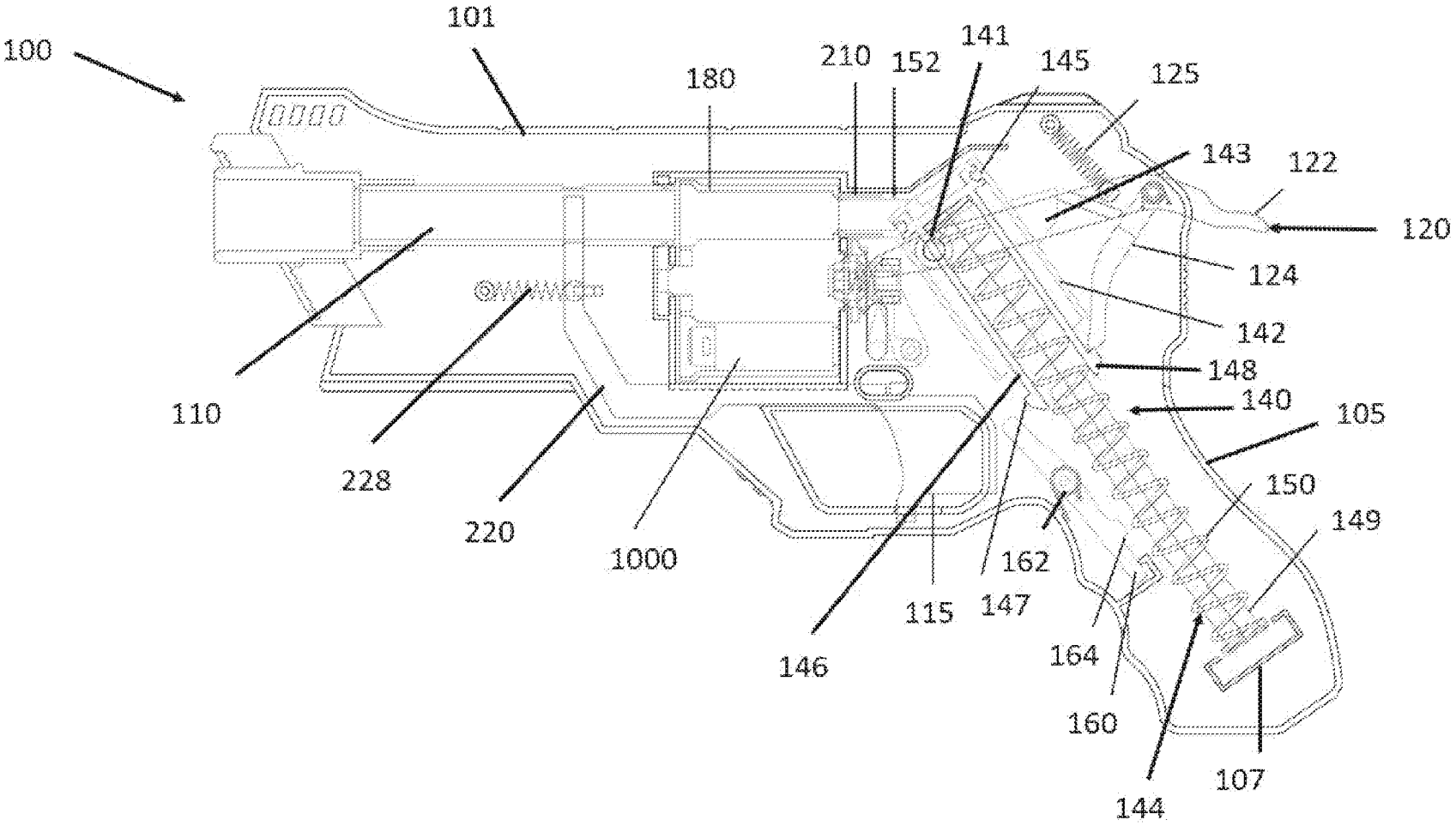
FIG. 1 is a schematic partial cross-sectional side view of key elements of a toy projectile launcher according to an exemplary embodiment of the present disclosure in an uncocked configuration.

FIG. 1 is a schematic partial cross-sectional view of key elements of a toy projectile launcher 100 according to an exemplary embodiment of the present disclosure. For clarity and simplicity in illustrating the key elements and mechanisms of toy projectile launcher 100, portions that are not necessary to understand the scope and the spirit of the present disclosure are not shown. One of ordinary skill in the art would readily understand the supporting elements needed to house and support the various illustrated elements, including those that facilitate the accommodation and advancement of belt 182 (see FIGS. 5A-5C) into and out of launcher 100, with various design choices that would not depart from the spirit and scope of the present disclosure.

FIG. 1 is a schematic side cross-sectional view of a projectile launcher 100 in an un-cocked position according to an exemplary embodiment of the present disclosure. As shown in FIG. 1, projectile launcher 100 is shaped to resemble a pistol with a cocking hammer. In embodiments, launcher 100 may be in various other shapes and arrangements without departing from the spirit and the scope of the disclosure, as detailed below. The launcher 100 includes a housing 101, a handle 105, a launch barrel 110, a trigger 115 and a cocking hammer 120. Disposed within the housing are a number of components, including an air piston assembly 140 and a cylinder 180 configured to house a plurality of projectiles, such as darts 1000.

The air piston assembly 140 is arranged at an angle within the housing 101 and includes a proximal end portion positioned within the handle 105 and a distal end portion positioned directly behind the cylinder 180. In exemplary embodiments, the air piston assembly 140 is completely contained in the handle 105, with no components of the air piston assembly extending from the handle 105 or housing 101.

The air piston assembly 140 includes a barrel 142 and an associated plunger element 144. According to an exemplary embodiment, barrel 142 of the air piston assembly 140 has a generally rounded cylindrical or an oval shape and plunger element 144 is biased away from a back wall 107 within the handle 105 of launcher housing 101 by a spring 150.

The barrel 142 includes a projection 143 that extends backwards towards the rear of the housing 101. As seen in the figures, the projection 143 has a sloping lower wall. The barrel 142 also includes at its front end an outlet port 152 that extends generally parallel to and in line with a projectile holder of the cylinder 180, as explained in further detail below.

The plunger element 144 incorporates a size and a shape that correspond with an internal circumference of barrel 142 so as to form an airtight seal with an internal surface of barrel 142. According to an exemplary embodiment of the present disclosure, plunger element 144 incorporates a resilient O-ring (made from a resilient material, such as a polymer) 145 to form an improved seal. In an exemplary embodiment, the resilient O-ring is disposed at the distal end of a plunger rod 149. The spring 150 is disposed around the plunger rod 149 so that the spring 150 is guided by the rod 149 as the spring 150 extends and contracts during operation of the launcher 100.

In an exemplary embodiment, the plunger element 144 also includes a plunger outer wall 146 that extends back from the forward end of the plunger element 144. The plunger outer wall 146 includes a first protrusion 147 that extends outwards towards the front of the housing 101 and a second protrusion 148 that extends outwards towards the back of the housing 101. In exemplary embodiments, at least a portion of the spring 150 extends between the plunger rod 149 and the plunger outer wall 146.

Also disposed within the housing 101 is a trigger arm 160. The trigger arm 160 generally runs adjacent to and parallel with the plunger rod 149 and is also disposed adjacent to the trigger 115. The trigger arm 160 is pivotably attached to an internal wall of the housing 101 by a first biasing spring 162. The first biasing spring 162 is configured to bias the trigger arm 160 in a counter-clockwise direction. A trigger arm protrusion 164 extends from a proximal end portion of the trigger arm 160 towards the plunger element 144.

In the initial configuration shown in FIG. 1, the pistol 100 is at rest with the hammer 120 in the un-cocked position. The hammer 120 includes a hammer arm 122 that is pivotably attached at its distal end portion to a post 141 that is disposed on an external wall of the barrel 142 of the air piston assembly 140. A proximal end portion of the hammer arm 122 is pivotably attached to a first lever arm 124. Another proximal end portion of the hammer arm 122 is biased upwards towards the top of the housing 101 by a second biasing spring 125.

In this initial state, a distal end portion of the first lever arm 124 rests on the second protrusion 148 of the plunger outer wall 146. The weight of the hammer arm 122 and first lever arm 124 is not enough to overcome the upwards pull of the second biasing spring 125 and the upwards push of the spring 150 so that the plunger element 144 in this initial state is not pulled downwards by the first lever arm 124 and remains within and sealed with the barrel 142.

Figure 2:
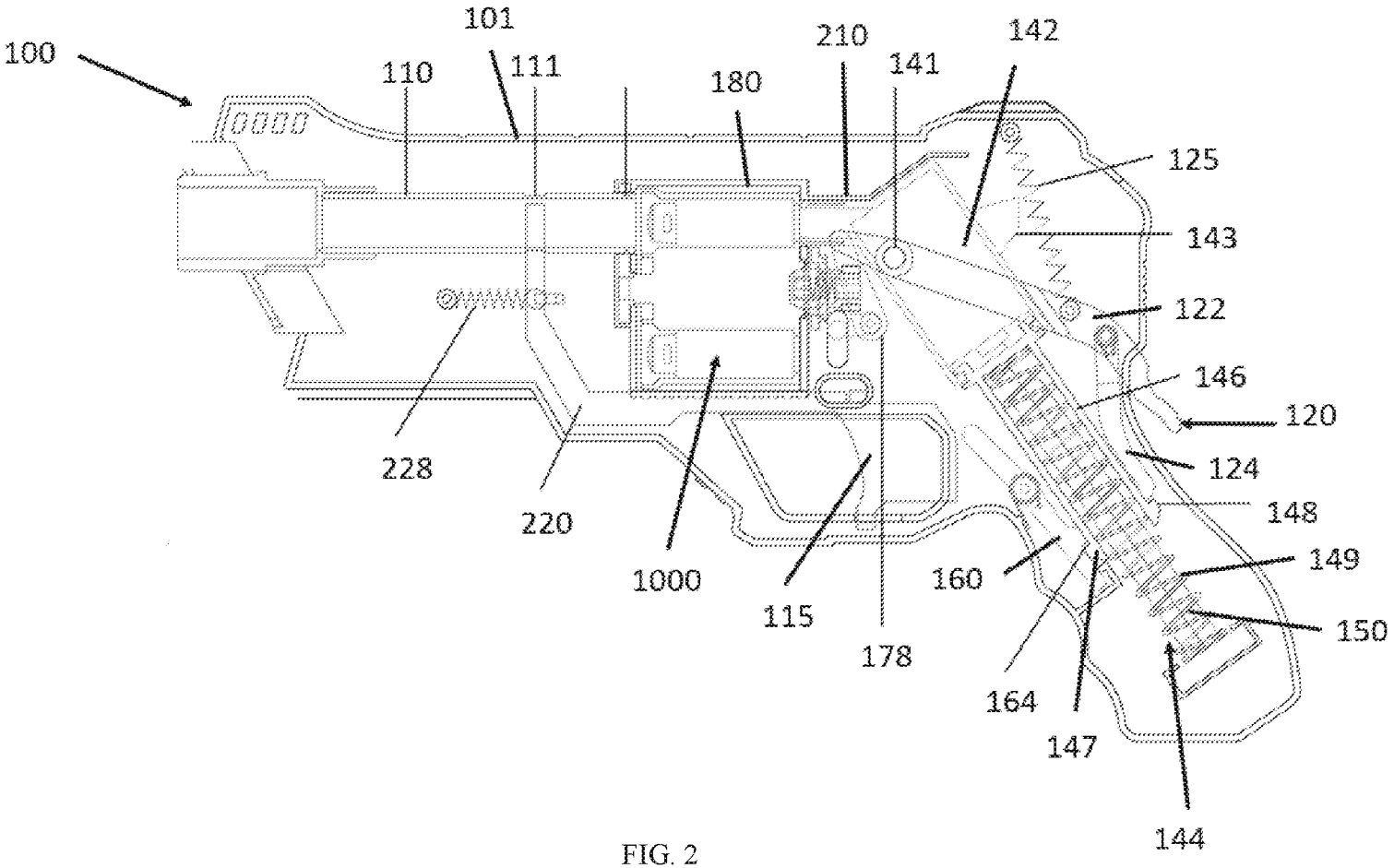
FIG. 2 is a schematic partial cross-sectional side view of key elements of a toy projectile launcher according to an exemplary embodiment of the present disclosure in a cocked configuration with the hammer pulled down.

FIG. 2 is a schematic side cross-sectional view of the projectile launcher 100 according to an exemplary embodiment of the present invention. In the configuration shown, the hammer 120 has been pulled down and the launcher 100 is in the cocked state. Specifically, when the hammer 120 is pulled down, the first lever arm 124 pivots relative to the hammer arm 122 and pushes downward on the second protrusion 148. This in turn causes the spring 150 to be pulled backwards until the forward end of the plunger element 144 contacts the back wall of the barrel 142.

Figure 3:
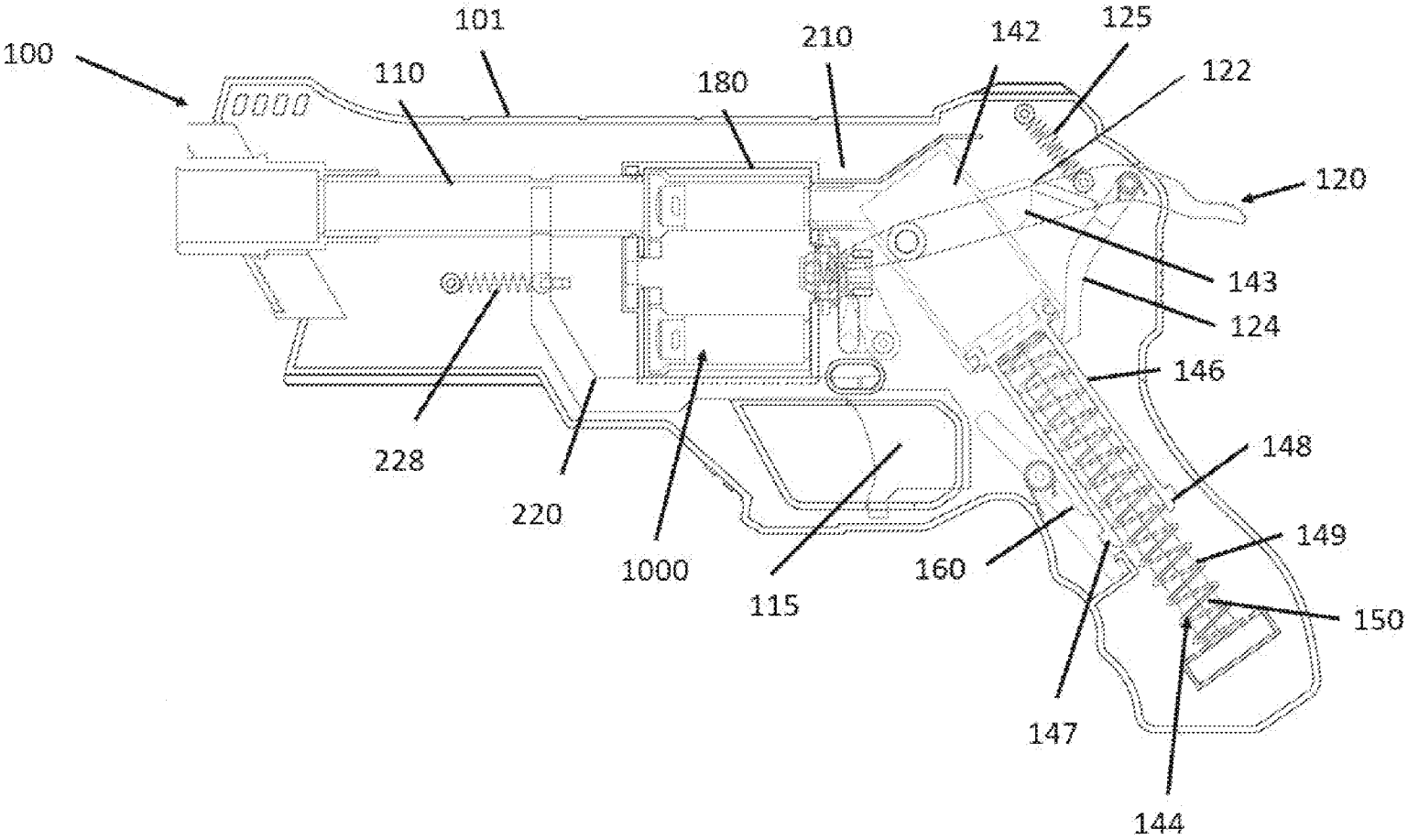
FIG. 3 is a schematic partial cross-sectional side view of key elements of a toy projectile launcher according to an exemplary embodiment of the present disclosure in a cocked configuration with the hammer released.

Meanwhile, the first protrusion 147 is pushed back until it encounters a rear sloped side wall of the trigger arm protrusion 164, at which point the first protrusion slides over the trigger arm protrusion 164 against the counter-clockwise bias of the trigger arm 160 until it reaches the other side of the trigger arm protrusion 164 and comes to rest adjacent to a front side wall of the trigger arm protrusion 164. This latching of the first protrusion 147 by the trigger arm protrusion 164 results in the plunger element 144 being held in the cocked position, as shown in FIG. 3.

Figure 5A:
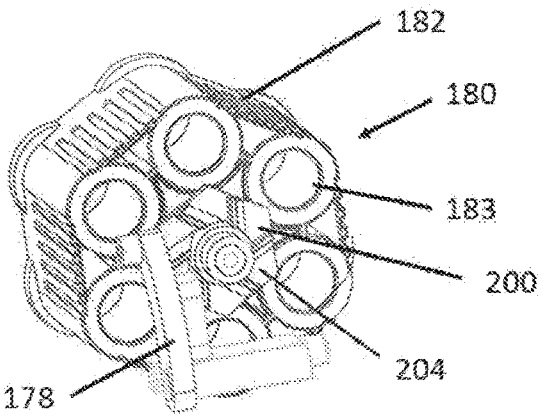
FIGS. 5A-5C are perspective, side and back views, respectively, of a storage cylinder according to an exemplary embodiment of the present invention.
Figure 5C:
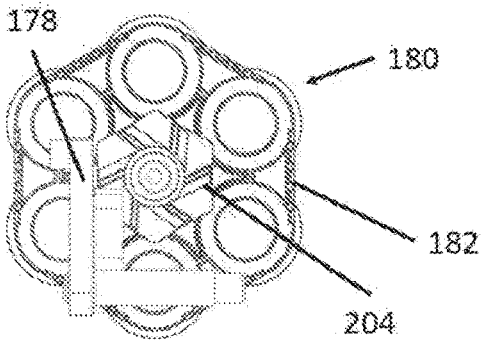
Figure 5B:
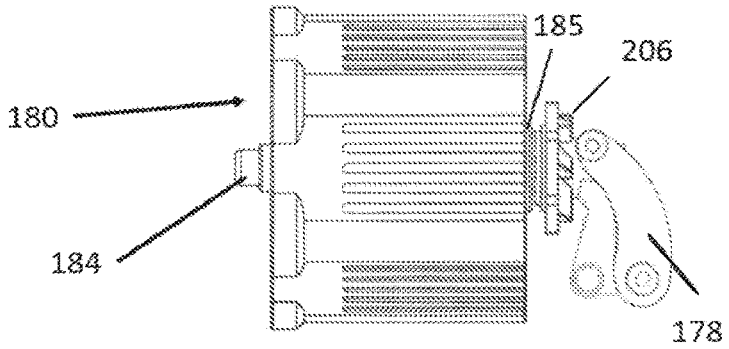

The cylinder 180 is configured to hold a number of projectiles, such as foam darts. In this regard, the cylinder 180 may have components including a belt and an advancement mechanism, as described in PCT Application No. PCT/SG2021/050186, the contents of which are incorporated herein by reference in their entirety. More specifically, as shown in FIGS. 5A, 5B and 5C, the cylinder 180 may include a belt 182 made up of six (6) or any other number of dart holders 183, each dimensioned to accommodate a foam dart 1000 for use with launcher 100. The dart holders 183 may be pivotably connected to one another by, for example, a hinge. In an exemplary embodiment, the belt 182 is wrapped around a core structure 184 that engages with an advancement mechanism 200 as explained in more detail below.

Figure 5D:
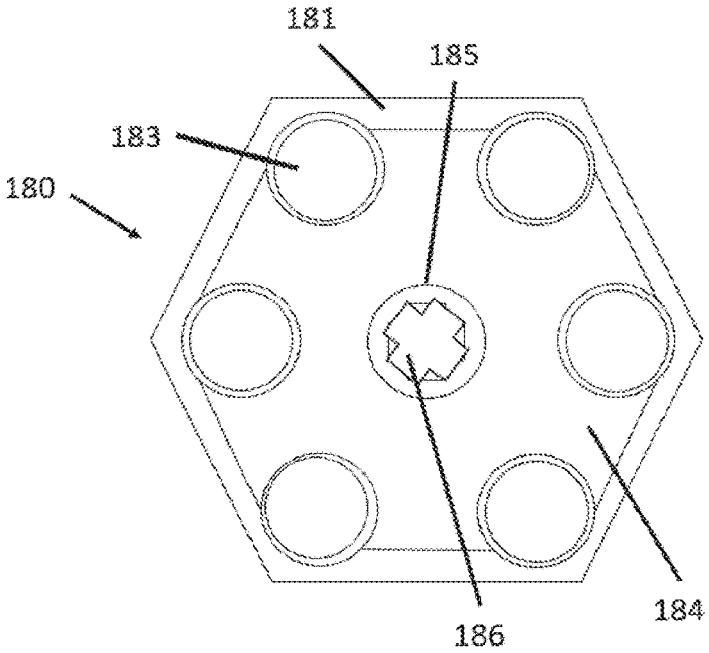
FIG. 5D is a back view of a storage cylinder according to an exemplary embodiment of the present invention.

As shown in FIG. 5D, in exemplary embodiments, the cylinder 180 has a unitary structure made up of an outer casing 181 and a number of tubular openings that form the dart holders 183. The core structure 184 is disposed within the outer casing 181 and in an exemplary embodiment the core structure 184 may be mounted within the casing 181 on a spring that biases the core structure 184 outwards towards the rear of the launcher 100. This allows the cylinder 180 to be removed from the launcher 100 if desired and either be reloaded and placed back into the launcher or replaced with an already loaded new cylinder 180. The rear face of the core structure 184 includes an engagement mechanism 185 which in turn includes a number of openings 186. The openings 186 are configured so as to be engaged with a corresponding number of protrusions extending from the front of an advancement mechanism 200 that is rotatably mounted within the housing 101. The rear of the advancement mechanism 200 may include a back plate 204 having a series of ridges 206 arranged around a central axis of the advancement mechanism 200. In exemplary embodiments, the number of ridges 206 may be the same as the number of dart holders 183.

As shown in FIGS. 5A-5C, and as also shown in FIG. 2, a second lever arm 178 is pivotally attached to a distal end portion of the hammer arm 124. As the hammer 120 is cocked downwards, the second lever arm 178 is pulled upwards by the hammer arm 122, which in turn causes the second lever arm 178 to engage with one of the ridges 206 of the back plate 204 of the advancement mechanism 200, thereby rotating the advancement mechanism 200 in the clockwise direction as viewed from the rear of the launcher 100. Since the front of the advancement mechanism 200 is engaged with the core structure 184 through the engagement mechanism 185, rotation of the advancement mechanism in turn causes corresponding rotation of the cylinder 180. Thus, with each downwards depression of the hammer 120, a projectile is advanced to be in-line with the front opening of the barrel 142 of the air piston assembly 140. As explained in further detail below, a rubberized collar 210 is attached to the front opening of the barrel 142 and serves as a seal pushing against the rear wall of each dart holder 183.

Figure 6A:
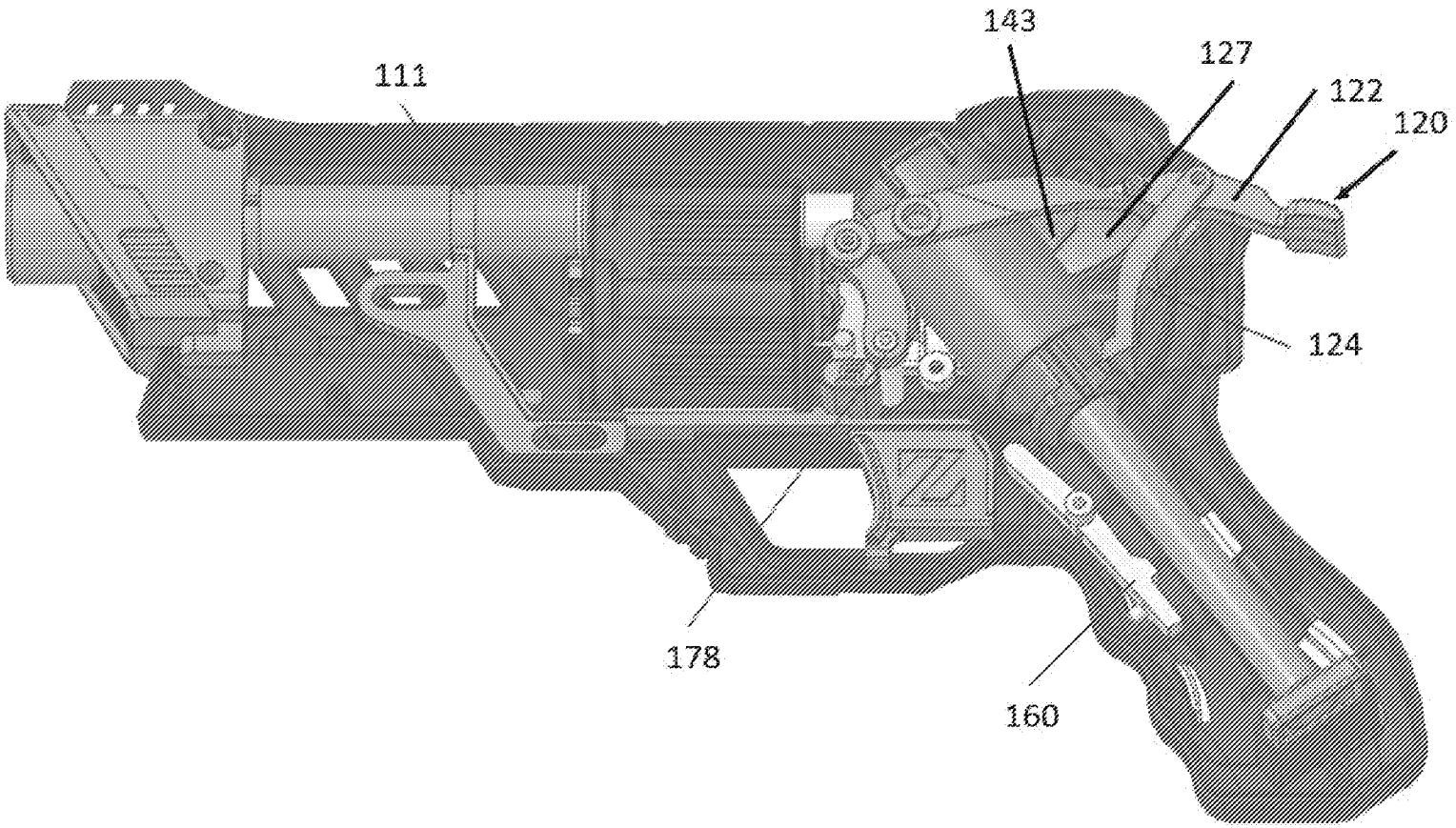
FIG. 6A illustrate internal components of a toy projectile launcher according to an exemplary embodiment of the present disclosure in an uncocked configuration.
Figure 6B:
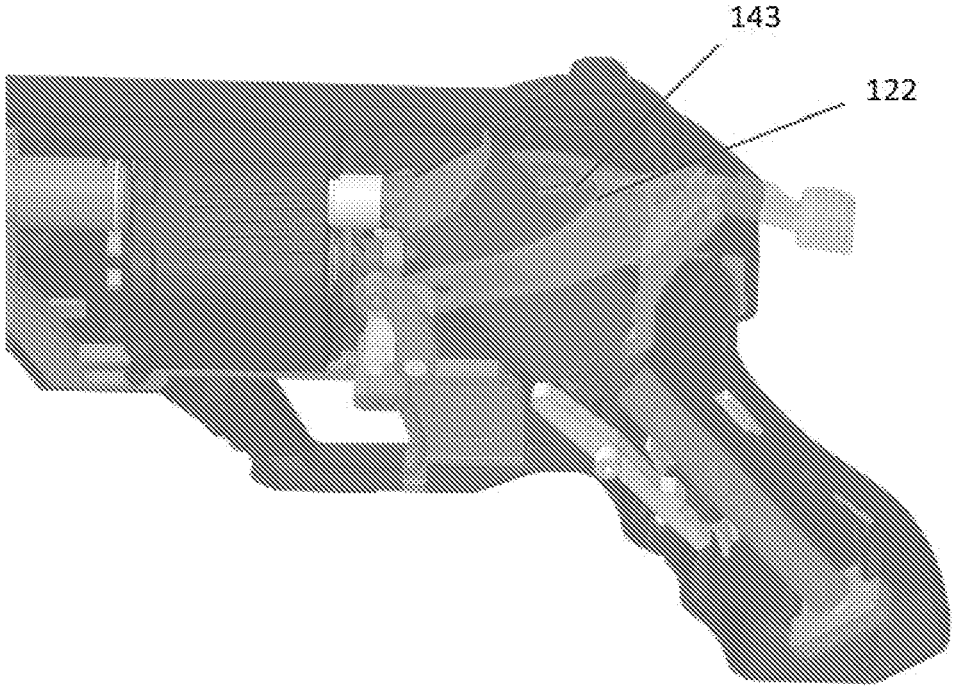
FIG. 6B illustrate internal components of a toy projectile launcher according to an exemplary embodiment of the present disclosure in an uncocked configuration.
Figure 6C:
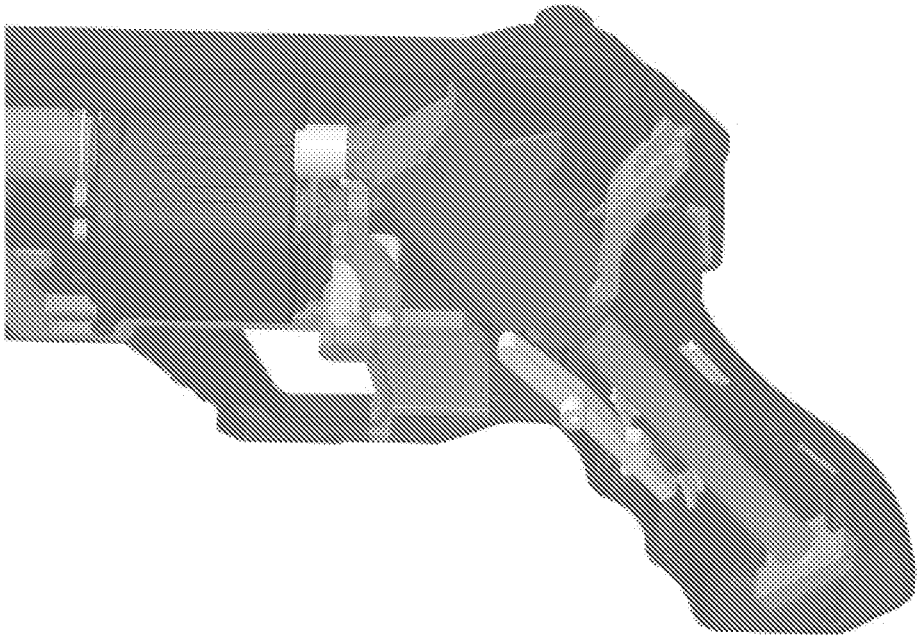
FIG. 6C illustrate internal components of a toy projectile launcher according to an exemplary embodiment of the present disclosure in an uncocked configuration with the hammer removed for improved view of the components.

FIGS. 6A, 6B and 6C show in more detail the hammer 120 and its engagement with the protrusion 143 of the barrel 142 and its operation in causing rotation of the cylinder 180. As shown in those figures, the hammer arm 122 in accordance with an exemplary embodiment of the invention may be U-shaped with a tail end so as to resemble a boot spur, where the tail end extends outwards from the housing 101 so that a user may press down on the tail end to cock the launcher 100. The spur arms of the hammer arm 122 extend around opposite sides of the barrel 142, and the end portion of each spur arm is attached to a respective side of the barrel 142 via a post 141A, 141B.

When the hammer arm 122 is pulled upward by the second biasing spring 125 into its resting position, the hammer arm 122 presses upwards against the protrusion 143 on the barrel 122. The U-shaped portion of the hammer arm 122 includes a wall 127 that is sloped inwards towards the protrusion 143 so that there is enough clearance between the lower sloped wall of the protrusion 143 and the wall 127 to allow the hammer arm 122 to move upwards until it encounters the outer edge of the protrusion 143. The upward force of the hammer arm 122 on the protrusion 143 at this point presses the collar 210 against the rear opening of the dart holder 183 to form the rear seal.

When the hammer 120 is pulled down, pressure on the protrusion 143 is released, thereby allowing the entire air piston assembly 120 to move back slightly. The backwards movement forms a small gap between the distal end of the hammer arm 122 and the back plate 204, thereby allowing the second lever arm 178 to rotate the advancement mechanism 200 to advance the cylinder 180 one chamber position and to bring the next dart in line with the exit of the barrel 122.

When the hammer 120 is released, the second biasing spring 125 pulls the hammer arm 122 back up so that hammer arm 122 again comes into contact with the protrusion 143 and the entire air piston assembly 120 is again gently pressed forward.

Also disposed within the housing 101 is a trigger lever 220, which is biased in a forward position by a third biasing spring 228. A proximal end portion of the trigger lever 220 is attached to the trigger 115 and a distal end portion of the trigger lever 220 is attached to the launch barrel 110. In this regard, the launch barrel 110 includes a depression 111 into which the distal end portion of the trigger lever 220 is inserted.

Figure 4:
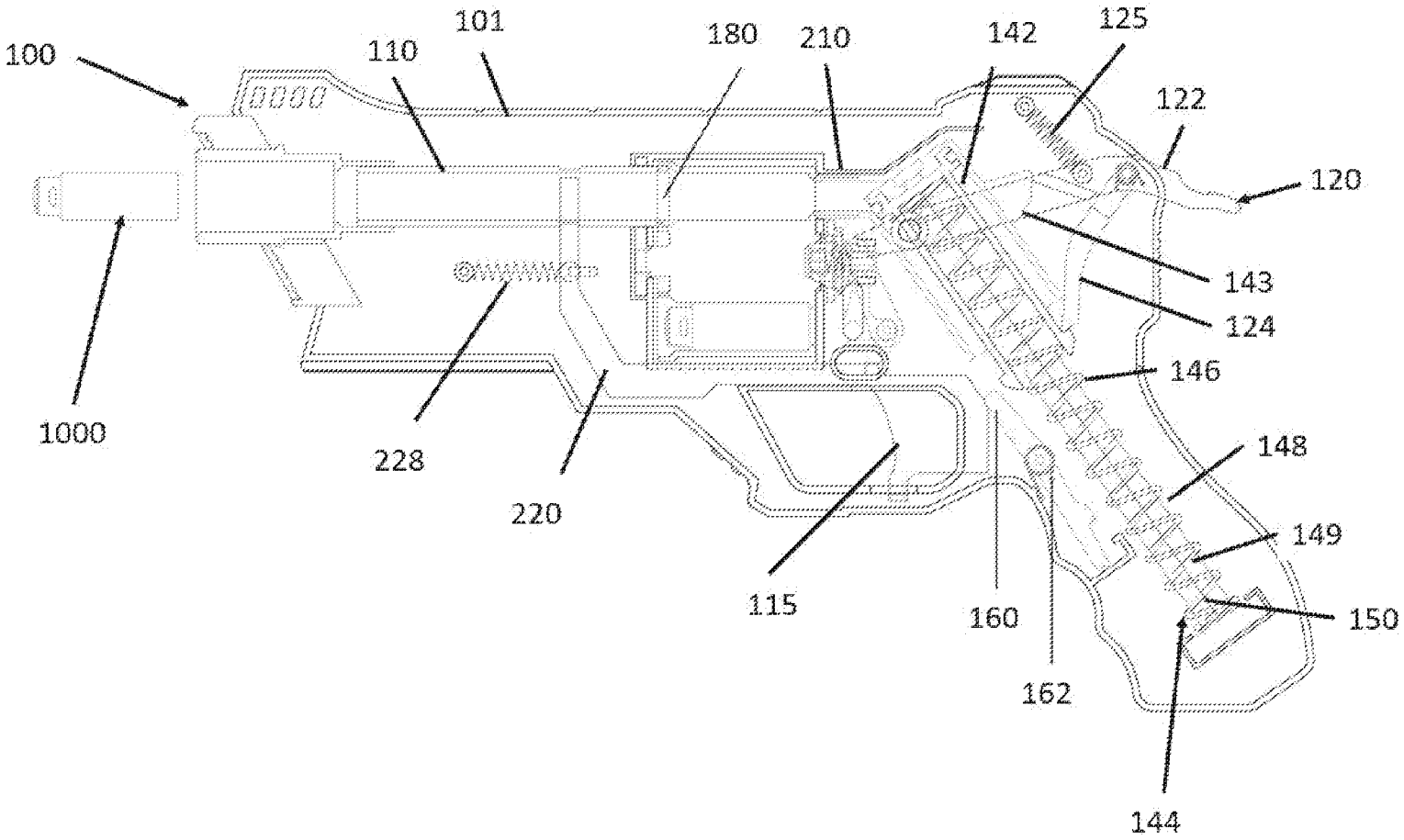
FIG. 4 is a schematic partial cross-sectional side view of key elements of a toy projectile launcher according to an exemplary embodiment of the present disclosure after a trigger pull.

As shown in FIG. 4, upon a pull of the trigger 115, the trigger lever 220 is pulled backwards, thereby moving the launch barrel 110 into the front of the dart holder 183 holding a projectile that is intended for launch. This provides the dart holder 183 with a front seal so that the dart holder 183 is now sealed at both ends. In exemplary embodiments, the rear of the launch barrel 110 may be provided with a resilient O-ring to enhance the front seal. However, it should be appreciated that an O-ring is not necessary and other exemplary embodiments may provide the front seal by close tolerances between the rear section of the launch barrel 110 and the front of the projectile holder 183.

Further pulling on the trigger 115 results in the trigger 115 contacting with and pushing back on a distal end portion of the trigger arm 160. This in turn results in clockwise rotation of the trigger arm 160 against the first biasing spring 162 until the trigger arm protrusion 164 releases the first protrusion 147 of the plunger element 144. The spring 150 is now free to rapidly push the plunger element 144 upwards into engagement with the distal end of the barrel 142, thereby driving air out of the barrel 142 to launch a projectile from the dart holder 183 and out of the launch barrel 110.

When the trigger 115 is released, the third biasing spring 228 pulls the trigger 115 forward to its resting configuration. This will also release the trigger arm 160 and allow it to rotate counterclockwise back to its resting configuration.

FIGS. 7-10 are schematic side cross-sectional views of a projectile launcher 1100 according to another exemplary embodiment of the present invention. The launcher 1100 in this exemplary embodiment differs from the previously described exemplary embodiments in that the launching barrel is fixed rather than reciprocating and the projectile cylinder moves back and forth to form the front seal with the launch barrel.

As shown in FIGS. 7-10, the projectile launcher generally includes similar components as the launcher 100, including a housing 1101, a handle 1105, a launch barrel 1110, a trigger 1115 and a cocking hammer 1120. Disposed within the housing are a number of components, including an air piston assembly 1140 and a cylinder 1180 configured to house a plurality of projectiles, such as darts 1000.

The air piston assembly 1140 is arranged at an angle within the housing 1101 and includes a proximal end portion positioned within the handle 1105 and a distal end portion positioned directly behind the cylinder 1160. In an exemplary embodiment, the entirety of the air piston assembly 1140 is contained within the handle 1105. The air piston assembly 1140 includes a barrel 1142 and an associated plunger element 1144. According to an exemplary embodiment, barrel 1142 of the air piston assembly 1140 has a generally rounded cylindrical or an oval shape and plunger element 1144 is biased away from a back wall 1107 within the handle 1105 of launcher housing 1101 by a spring 1150. The barrel 1142 includes a projection 1143 that extends backwards towards the rear of the housing 1101. As seen in the figures, the projection 1143 has a sloping lower wall. The barrel 142 also includes at its front end an outlet port 1152 that extends generally parallel to and in line with a projectile holder of the cylinder 1160. The outlet port 1152 may be made up of at least two telescoping sections linked by a spring 1153 so as to allow the cylinder 1180 to reciprocate relative to the air piston assembly 1140.

The plunger element 1144 incorporates a size and a shape that correspond with an internal circumference of barrel 1142 so as to form an airtight seal with an internal surface of barrel 1142. According to an exemplary embodiment of the present disclosure, plunger element 1144 incorporates a resilient O-ring (made from a resilient material, such as a polymer) 1145 to form an improved seal. In an exemplary embodiment, the resilient O-ring is disposed at the distal end of a plunger rod 1149. The spring 1150 is disposed around the plunger rod 1149 so that the spring 1150 is guided by the rod 1149 as the spring 1150 extends and contracts during operation of the launcher 1100.

In an exemplary embodiment, the plunger element 1144 also includes a plunger outer wall 1146 that extends back from the forward end of the plunger element 1144. The plunger outer wall 1146 includes a first protrusion 1147 that extends outwards towards the front of the housing 1101 and a second protrusion 1148 that extends outwards towards the back of the housing 1101. In exemplary embodiments, at least a portion of the spring 1150 extends between the plunger rod 1149 and the plunger outer wall 1146.

Also disposed within the housing 1101 is a trigger arm 1160. The trigger arm 1160 generally runs adjacent to and parallel with the plunger rod 1149 and is also disposed adjacent to the trigger 1115. The trigger arm 1160 is pivotably attached to an internal wall of the housing 1101 by a first biasing spring 1162. The first biasing spring 1162 is configured to bias the trigger arm 1160 in a counter-clockwise direction. A trigger arm protrusion 1164 extends from a proximal end portion of the trigger arm 1160 towards the plunger element 1144.

Figure 7:
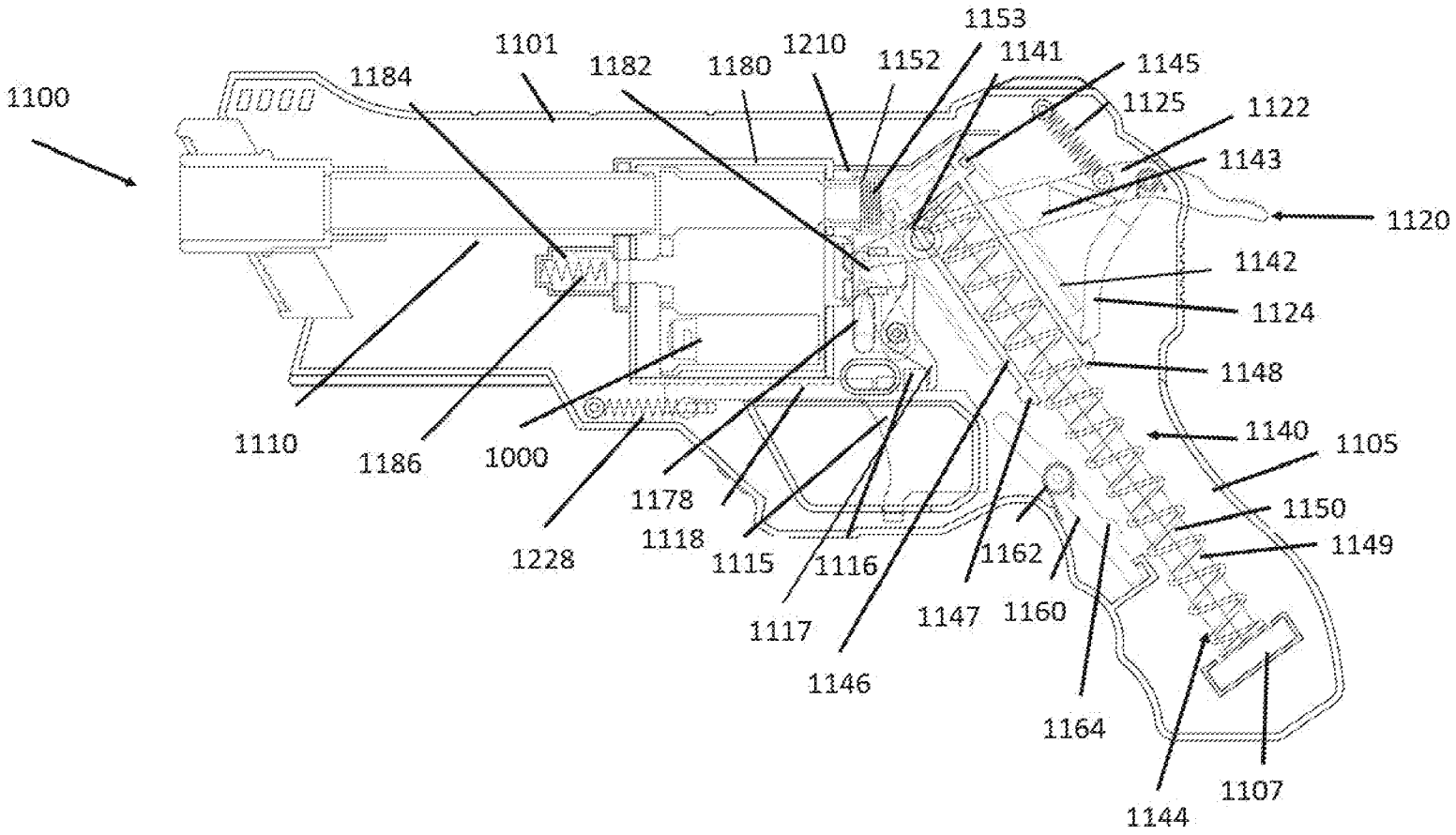
FIG. 7 is a schematic partial cross-sectional side view of key elements of a toy projectile launcher according to an exemplary embodiment of the present disclosure in an uncocked configuration.

In the initial configuration shown in FIG. 7, the pistol 1100 is at rest with the hammer 1120 in the un-cocked position. The hammer 1120 includes a hammer arm 1122 that is pivotably attached at its distal end portion to a post 1141 that is disposed on an external wall of the barrel 1142 of the air piston assembly 1140. A proximal end portion of the hammer arm 1122 is pivotably attached to a first lever arm 1124. Another proximal end portion of the hammer arm 1122 is biased upwards towards the top of the housing 1101 by a second biasing spring 1125.

In this initial state, a distal end portion of the first lever arm 1124 rests on the second protrusion 1148 of the plunger outer wall 1146. The weight of the hammer arm 1122 and first lever arm 1124 is not enough to overcome the upwards pull of the second biasing spring 1125 and the upwards push of the spring 1150 so that the plunger element 1144 in this initial state is not pulled downwards by the first lever arm 1124 and remains within and sealed with the barrel 1142.

Figure 8:
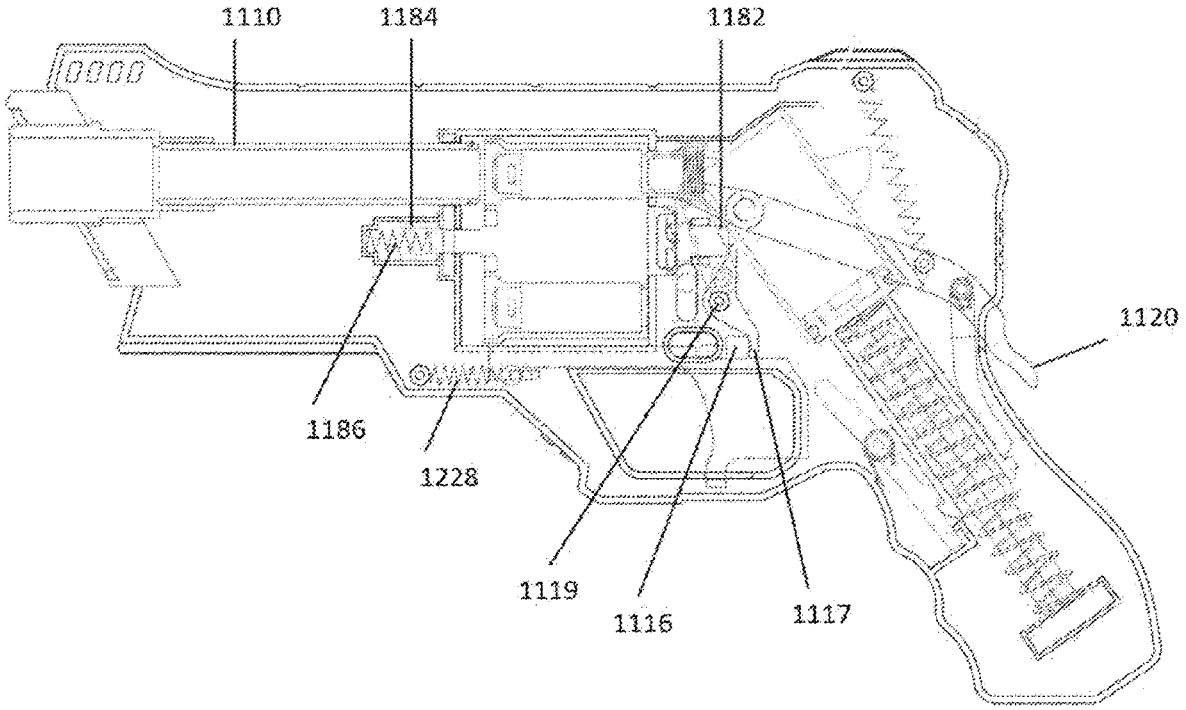
FIG. 8 is a schematic partial cross-sectional side view of key elements of a toy projectile launcher according to an exemplary embodiment of the present disclosure in a cocked configuration with the hammer pulled down.
Figure 9:
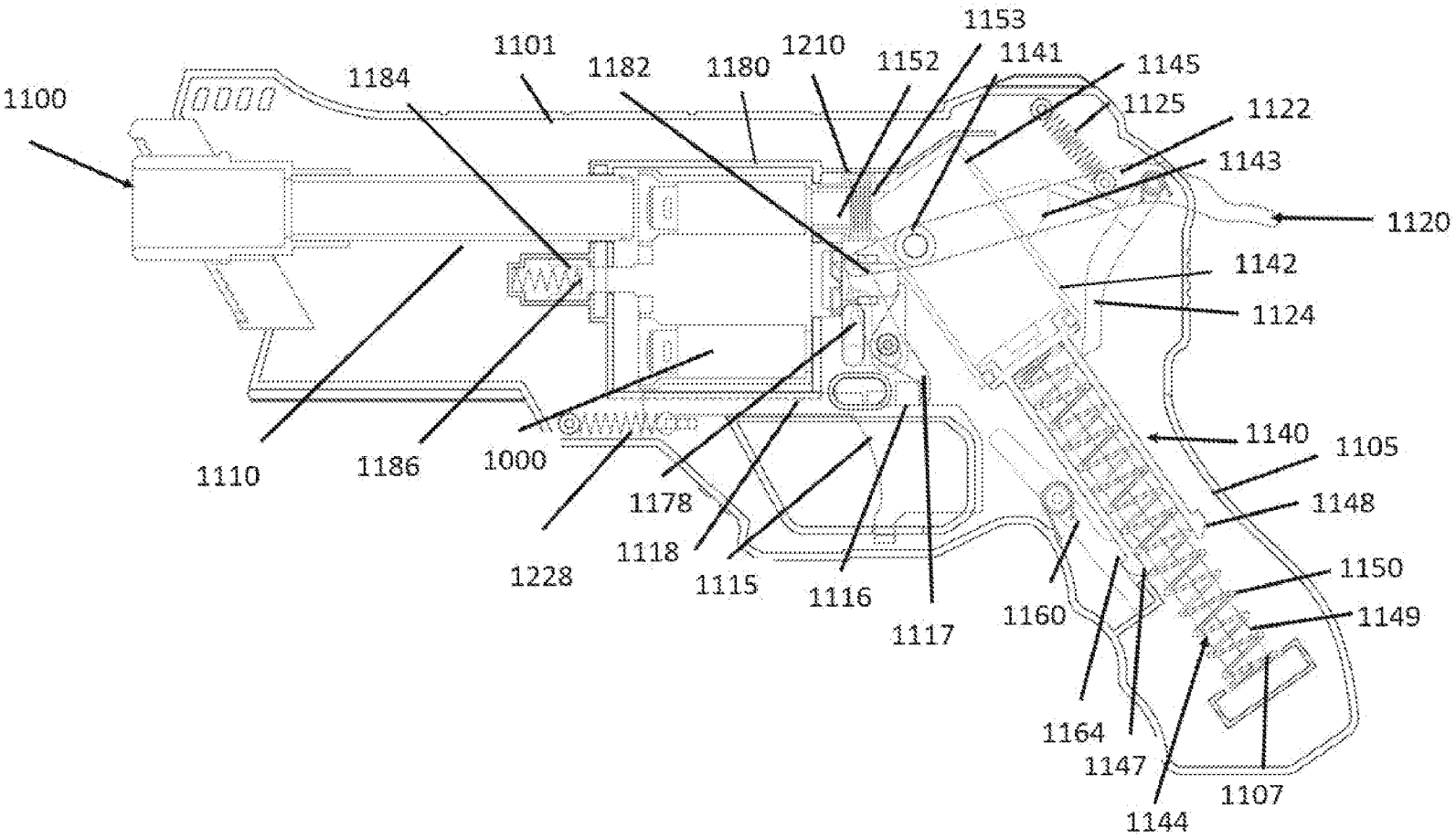
FIG. 9 is a schematic partial cross-sectional side view of key elements of a toy projectile launcher according to an exemplary embodiment of the present disclosure in a cocked configuration with the hammer released.

FIG. 8 shows the launcher 1100 in the cocked state with the hammer 1120 pulled down. Specifically, when the hammer 1120 is pulled down, the first lever arm 1124 pivots relative to the hammer arm 1122 and pushes downward on the second protrusion 1148. This in turn causes the spring 1150 to be pulled backwards until the forward end of the plunger element 1144 contacts the back wall of the barrel 1142. Meanwhile, the first protrusion 1147 is pushed back until it encounters a rear sloped side wall of the trigger arm protrusion 1164, at which point the first protrusion 1147 slides over the trigger arm protrusion 1164 against the counter-clockwise bias of the trigger arm 1160 until it reaches the other side of the trigger arm protrusion 1164 and comes to rest adjacent to a front side wall of the trigger arm protrusion 1164. This latching of the first protrusion 1147 by the trigger arm protrusion 1164 results in the plunger element 1144 being held in the cocked position, as shown in FIG. 9.

The cylinder 1180 is configured to hold a number of projectiles, such as foam darts. In this regard, the cylinder 1180 may have components including dart holders and an engagement mechanism, as described previously in regards to the prior exemplary embodiments. However, in the present exemplary embodiments, the cylinder 1180 has a rear extension 1182 and a front extension 1184 that houses a spring 1186. When the cylinder 1180 is pushed forward, the spring 1186 is compressed and a front seal is formed between a projectile holder of the cylinder 1180 and the rear of the launch barrel 1110, and once a projectile is launched, the spring 1186 pushes the cylinder 1180 back to its resting position.

A second lever arm 1178 is pivotally attached to a distal end portion of the hammer arm 1124. As the hammer 1120 is cocked downwards, the second lever arm 1178 is pulled upwards by the hammer arm 1122, which in turn causes the second lever arm 1178 to engage with the advancement mechanism, thereby rotating the cylinder 1180 in the clockwise direction as viewed from the rear of the launcher 100. Thus, with each downwards depression of the hammer 1120, a projectile is advanced to be in-line with the outlet port 1152 of the barrel 1142 of the air piston assembly 1140. A rubberized collar 1210 is attached to the front opening of the barrel 1142 and serves as a seal pushing against the rear wall of each dart holder 1183. The spring 1153 pushes the collar 1210 forward when the cylinder 1180 is pushed forward, thereby maintaining the rear seal of the projectile holder.

The trigger 1115 includes a trigger extension 1116 that protrudes into the housing 1101. As explained in further detail below, when the trigger 1115 is pulled back, the trigger extension 1116 engages with a push lever 1117 to thereby rotate the push lever 1117 into engagement with rear extension 1182 of the cylinder 1180 so as to push a projectile holder of the cylinder 1180 into sealing engagement with the rear of the launching barrel 1110. The push lever 1117 may be biased against the rotation caused by the trigger extension 1116 by, for example, a spring 1119. The trigger 1115 also includes a front extension 1118 that is attached at its distal end to a third biasing spring 1228 that holds the trigger 1115 in a forward position.

Figure 10:
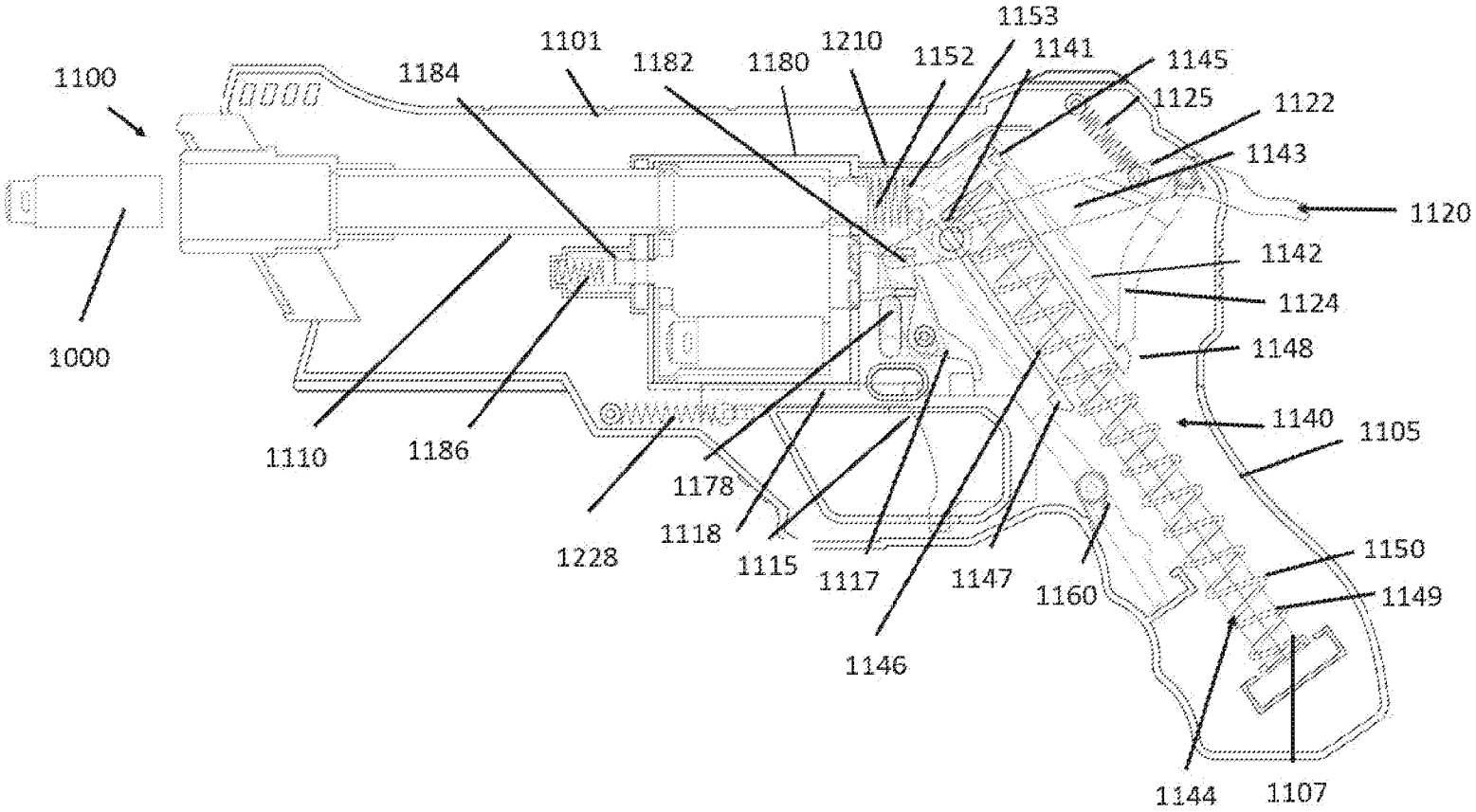
FIG. 10 is a schematic partial cross-sectional side view of key elements of a toy projectile launcher according to an exemplary embodiment of the present disclosure after a trigger pull.

The operation of the launcher 1100 is generally the same as the previously described exemplary embodiments. However, as shown in FIG. 10, upon a pull of the trigger 1115, the cylinder 1180 is pushed forward by the push lever 1117 so that the projectile holder housing the projectile intended for launch is moved into sealing engagement with the rear of the launch barrel 1110 to form the front seal. When the trigger 1115 is released, the third biasing spring 1228 pulls the trigger 1115 back to its forward position, thereby allowing the push lever 1117 to disengage from the cylinder 1180 so that the spring 1186 can push the cylinder 1180 back to its resting configuration. Once in the resting configuration, the cylinder 1180 is no longer in engagement with the launch barrel 1110 so that the cylinder 1180 is free to rotate when the hammer 1120 is pulled down to launch a subsequent projectile.

While particular embodiments of the present disclosure have been shown and described in detail, it would be obvious to those skilled in the art that various modifications and improvements thereon may be made without departing from the spirit and scope of the disclosure. It is therefore intended to cover all such modifications and improvements that are within the scope of this disclosure.

What is claimed is:

1. A toy projectile launcher comprising:

a housing;

an air piston assembly, the air piston assembly including an air piston barrel, a plunger element, and a compression spring;

a launch barrel;

a trigger comprising a trigger lever having a distal end portion connected to the launch barrel;

a storage cylinder rotatably mounted within the housing and comprising a plurality of projectile holders, wherein each projectile holder is configured to contain a projectile; and a spring that biases the launch barrel away from the storage cylinder, wherein, when the trigger is actuated, the trigger lever pulls the launch barrel into engagement with one of the projectile holders of the storage cylinder to form an airtight seal between a rear portion of the launch barrel and the one of the projectile holders.

2. The toy projectile launcher of claim 1, wherein the air piston barrel comprises an outlet port.

3. The toy projectile launcher of claim 2, wherein the plunger element further comprises:

an outer wall comprising a first extension and a second extension; and a plunger rod that is surrounded by the compressions spring, the compression spring being at least partially housed within the outer wall.

4. The toy projectile launcher of claim 3, further comprising:

a cocking hammer comprising:

a hammer arm having a first distal end portion pivotally attached to the air piston barrel; and a first lever arm having a proximal end portion pivotally attached to the hammer arm and a distal end portion in contact with the first extension of the outer wall of the plunger element;

a trigger arm that is pivotally attached to the housing and that comprises a protrusion having a sloping front wall and a back wall;

a second lever arm pivotally linked with a second distal end portion of the hammer arm and configured for engagement with the storage cylinder to cause rotation of the storage cylinder;

wherein, when the cocking hammer is moved from an upper position to a lower position:

the first lever arm pivots relative to the hammer arm and, due to the contact of the first lever arm with the first extension of the outer wall of the plunger element, pushes the plunger element into a cocked configuration in which the compression spring of the plunger element is compressed;

the second extension of the outer wall of the plunger element slides over the sloping front wall of the protrusion of the trigger arm and into engagement with the back wall of the protrusion of the plunger element so that the plunger element is held in the cocked configuration; and the hammer arm pivots downwards so that the second lever engages with the storage cylinder and causes the storage cylinder to rotate to place a projectile within one of the projectile holders in line with the outlet port of the air piston barrel and the launch barrel.

5. The toy projectile launcher of claim 4, further comprising a spring that biases the cocking hammer into the upper position so that, when the cocking hammer is released, the cocking hammer returns to the upper position while the plunger element remains in the cocked configuration.

6. The toy projectile launcher of claim 5, wherein, upon further actuation of the trigger, the trigger contacts the trigger arm to pivot the trigger arm out of engagement with the plunger element so that the compression spring is free to push the plunger element into the air piston barrel, thereby launching a projectile from the storage cylinder and out of the launch barrel.

7. The toy projectile launcher of claim 2, further comprising a resilient collar disposed adjacent to the outlet port so as to form an airtight seal at a rear portion of the one of the projectile holders.

8. The toy projectile launcher of claim 1, further comprising a handle.

9. The toy projectile launcher of claim 8, wherein the air piston assembly is at least partially disposed in the handle.

10. The toy projectile launcher of claim 8, wherein the air piston assembly is completely contained withing the handle.

11. The toy projectile launcher of claim 1, wherein, upon release of the trigger, the spring pulls the launch barrel away from the storage cylinder.

12. A toy projectile launcher comprising:

a housing;

an air piston assembly, the air piston assembly including an air piston barrel, a plunger element, and a compression spring;

a launch barrel;

a trigger comprising a trigger extension member;

a storage cylinder rotatably mounted within the housing and comprising a plurality of projectile holders, wherein each projectile holder is configured to contain a projectile;

a spring that biases the storage cylinder away from the launch barrel; and a push lever rotatably mounted in the housing, wherein, when the trigger is actuated, the trigger extension member engages with the push lever to rotate the push lever into engagement with the storage cylinder so that one of the projectile holders is pushed into engagement with a rear portion of the launch barrel to form an airtight seal between a rear portion of the launch barrel and the one of the projectile holders.

13. The toy projectile launcher of claim 12, wherein the air piston barrel comprises an outlet port.

14. The toy projectile launcher of claim 13, further comprising a resilient collar disposed adjacent to the outlet port so as to form an airtight seal at a rear portion of the one of the projectile holders.

15. The toy projectile launcher of claim 12, wherein the plunger element comprises:

an outer wall comprising a first extension and a second extension; and a plunger rod that is surrounded by the compressions spring, the compression spring being at least partially housed within the outer wall.

16. The toy projectile launcher of claim 15, further comprising:

a cocking hammer comprising:

a hammer arm having a first distal end portion pivotally attached to the air piston barrel; and a first lever arm having a proximal end portion pivotally attached to the hammer arm and a distal end portion in contact with the first extension of the outer wall of the plunger element;

a trigger arm that is pivotally attached to the housing and that comprises a protrusion having a sloping front wall and a back wall;

a second lever arm pivotally linked with a second distal end portion of the hammer arm and configured for engagement with the storage cylinder to cause rotation of the storage cylinder;

wherein, when the cocking hammer is moved from an upper position to a lower position:

the first lever arm pivots relative to the hammer arm and, due to the contact of the first lever arm with the first extension of the outer wall of the plunger element, pushes the plunger element into a cocked configuration in which the compression spring of the plunger element is compressed;

the second extension of the outer wall of the plunger element slides over the sloping front wall of the protrusion of the trigger arm and into engagement with the back wall of the protrusion of the plunger element so that the plunger element is held in the cocked configuration; and the hammer arm pivots downwards so that the second lever engages with the storage cylinder and causes the storage cylinder to rotate to place a projectile within one of the projectile holders in line with the outlet port of the air piston barrel and the launch barrel.

17. The toy projectile launcher of claim 16, further comprising a spring that biases the cocking hammer into the upper position so that, when the cocking hammer is released, the cocking hammer returns to the upper position while the plunger element remains in the cocked configuration.

18. The toy projectile launcher of claim 17, wherein, upon further actuation of the trigger, the trigger contacts the trigger arm to pivot the trigger arm out of engagement with the plunger element so that the compression spring is free to push the plunger element into the air piston barrel, thereby launching a projectile from the storage cylinder and out of the launch barrel.

19. The toy projectile launcher of claim 12, further comprising a handle.

20. The toy projectile launcher of claim 19, wherein the air piston assembly is at least partially disposed in the handle.

21. The toy projectile launcher of claim 19, wherein the air piston assembly is completely contained withing the handle.

22. The toy projectile launcher of claim 12, wherein, upon release of the trigger, the spring pushes the storage cylinder away from the launch barrel.

* * * * *